US009943456B2

(12) United States Patent
Goeckel

(10) Patent No.: US 9,943,456 B2
(45) Date of Patent: Apr. 17, 2018

(54) WHEELCHAIR BACK MOUNTING SYSTEM

(71) Applicant: ROHO, INC., Belleville, IL (US)

(72) Inventor: Gregory W. Goeckel, Belleville, IL (US)

(73) Assignee: ROHO, INC., Belleville, IL (US)

( * ) Notice: Subject to any disclaimer, the term of this patent is extended or adjusted under 35 U.S.C. 154(b) by 0 days.

(21) Appl. No.: 15/030,103

(22) PCT Filed: Aug. 12, 2014

(86) PCT No.: PCT/US2014/050692

§ 371 (c)(1),
(2) Date: Apr. 18, 2016

(87) PCT Pub. No.: WO2015/057295

PCT Pub. Date: Apr. 23, 2015

(65) Prior Publication Data

US 2016/0262965 A1 Sep. 15, 2016

Related U.S. Application Data

(60) Provisional application No. 61/947,724, filed on Mar. 4, 2014, provisional application No. 61/891,482, filed on Oct. 16, 2013.

(51) Int. Cl.
*A61G 5/10* (2006.01)
*A61G 5/12* (2006.01)

(52) U.S. Cl.
CPC ..... *A61G 5/1067* (2013.01); *A61G 5/12* (2013.01); *A61G 5/122* (2016.11)

(58) Field of Classification Search
CPC ..... A61G 5/1067; A61G 5/122; A61G 5/12
See application file for complete search history.

(56) References Cited

U.S. PATENT DOCUMENTS

| | | | | |
|---|---|---|---|---|
| 5,062,677 | A | 11/1991 | Jay et al. | |
| 5,556,168 | A | 9/1996 | Dinsmoor et al. | |
| 5,593,211 | A | 1/1997 | Jay et al. | |
| D407,353 | S | 3/1999 | Bar et al. | |
| D408,767 | S | 4/1999 | Bar et al. | |
| D412,685 | S | 8/1999 | Bar et al. | |
| D413,085 | S | 8/1999 | Bar et al. | |
| D413,841 | S | 9/1999 | Bar et al. | |
| 6,095,611 | A * | 8/2000 | Bar | A61G 5/1067 297/228.13 |

(Continued)

FOREIGN PATENT DOCUMENTS

EP 1974707 A2 10/2008

*Primary Examiner* — Philip F Gabler
(74) *Attorney, Agent, or Firm* — Polsinelli PC

(57) ABSTRACT

A system for attaching a wheelchair back to wheelchair posts comprising a bracket and interchangeable attachment hardware secured to the bracket. In one aspect the bracket can be adjusted vertically relative to the wheelchair back and can be adjusted on a horizontal path. In one aspect, the angular orientation of the attachment hardware can be adjusted to adjust the angular position of the wheelchair back relative to the wheelchair seat and posts. In one aspect the attachment hardware is represented by a hanger assembly. In one aspect the attachment hardware is represented by an expansion plug assembly for insertion into the open tubular end of a wheelchair post.

18 Claims, 12 Drawing Sheets

(56) References Cited

U.S. PATENT DOCUMENTS

| | | | | |
|---|---|---|---|---|
| 6,474,743 | B1 | 11/2002 | Bar et al. | |
| 6,889,993 | B2 * | 5/2005 | Chen | A61G 5/1059 280/220 |
| 7,104,610 | B2 * | 9/2006 | Cramer | A61G 5/12 248/230.1 |
| 7,188,902 | B1 | 3/2007 | Chen | |
| 7,980,580 | B2 | 7/2011 | Lowenthal et al. | |
| 8,197,009 | B2 * | 6/2012 | Whelan | A61G 5/10 297/440.2 |
| 8,376,463 | B2 * | 2/2013 | Cooper | A61G 5/02 297/354.11 |
| 2004/0066081 | A1 * | 4/2004 | Dennon | A61G 5/10 297/440.2 |
| 2007/0085300 | A1 * | 4/2007 | Loewenthal | A61G 5/12 280/304.1 |
| 2008/0157581 | A1 * | 7/2008 | Whelan | A61G 5/1067 297/440.2 |
| 2012/0091300 | A1 * | 4/2012 | Bee | A61G 5/1067 248/219.4 |
| 2012/0326482 | A1 * | 12/2012 | Goeckel | A61G 5/1067 297/440.2 |

* cited by examiner

WHEELCHAIR BACK MOUNTING SYSTEM

RELATED APPLICATIONS

This application claims the benefit of U.S. provisional application Ser. No. 61/891,482 filed Oct. 16, 2013 and U.S. provisional application Ser. No. 61/947,724 filed Mar. 4, 2014, both of which are incorporated herein by reference.

BACKGROUND ART

The disclosure relates generally to mounting assemblies to lo secure wheelchair back supports to the canes or posts of wheelchairs. In one aspect, the mounting assembly is a modular system that can accommodate different types of attachment hardware. One aspect includes a triangle bracket slidingly attached to the wheelchair back. Various types of attachment hardware for attaching the back to the wheelchair posts are mounted to the bracket.

Wheelchairs generally comprise a frame with surface engaging wheels, a seating surface and a back support. The frame usually is made from tubular steel or the like. The seat and back can be a more pliant or flexible material such as vinyl or canvas for example. The frame includes two spaced apart upright members behind the seat, sometimes referred to as posts or canes. The back support usually is suspended in a generally vertical orientation between the posts.

In many cases the original back support does not provide sufficient or appropriate support, or is not positioned in between the wheel chair posts to meet the seated user's specific physical needs or tastes. The user may replace the original equipment back support with another back support, for example a more versatile or adjustable back support or one that is more rigid or firmer. These back supports can be attached to the original equipment posts or the posts can be removed and the replacement back installed.

Known back rests and mounting assemblies for back rests are complex and do not always allow for simple adjustment of the back rest, for example, without a tool. They generally include a back and do not provide for a mounting assembly that can be used to mount different back supports between the wheel chair posts. Moreover, they generally have a number of different adjustment points that must be operated to vary the angular position, vertical position and horizontal position or location of the back relative to the seat or posts. It would be advantageous, therefore, to have a modular wheelchair back mounting system for a wheelchair back that can be used with different attachment hardware and that allows for adjustment of the back in a plurality of ways, preferably using a single adjustment point and that can be adjusted with the user seated in the wheelchair.

SUMMARY OF THE INVENTION

A modular mounting system to mount a wheelchair back between the posts or canes of a wheel chair is described. The system comprises a bracket adjustably attached to a wheelchair back and interchangeable attachment hardware secured to the bracket for attachment of the back to wheelchair post.

In one aspect, the mounting system includes a pair of triangular brackets, one mounted on each side of the wheelchair back in a vertical slot such that the bracket can be adjusted vertically by sliding it up or down in the slot in the wheelchair back. Mounting hardware for mounting the back to a wheelchair post is attached to the bracket. A bracket face includes a horizontal slot for sliding attachment of the mounting hardware such that the mounting hardware can be moved back and forth along a horizontal path to adjust the horizontal position of the back.

In one aspect, the mounting hardware comprises a rotatable hanger bracket for engaging horizontally disposed hanger posts extending from the wheelchair posts. The bracket face and a mounting hardware surface, e.g., a surface of the hanger bracket, comprise complementary texturing. The hanger bracket can be rotated relative to the bracket face such that the angle of the wheelchair back relative to the wheelchair posts can be adjusted. The complementary textured surfaces can interlock to help secure the back in a desired angular position.

In one aspect, the triangle bracket is secured in the slot by a slider bar.

In one aspect, the triangle bracket is secured in the slot by slides.

In one aspect the triangle bracket is secured in the slot by plate.

In one aspect the triangle bracket is secured in the slot by bolt heads.

In one aspect, the triangle bracket is secured to the slider bar or plate by a single bolt.

In one aspect the mounting hardware comprises a quick-release assembly attached to the bracket on each side of the back for removably mounting the wheelchair back to wheelchair posts. The quick-release assembly comprises a tubular quick release mechanism or expansion plug that is introduced into an open end of a tubular wheelchair post and secured by a pressure latch.

In one aspect, the single bolt also secures the hanger bracket to the triangular bracket such that one bolt can adjust the vertical, horizontal and angular position of the wheelchair back relative to the wheelchair posts.

In one aspect, the mounting system includes adjustment apparatus which allows for selective adjustment of at least the angular (or tilt), the vertical and the horizontal positions of the wheelchair back.

In one aspect the mounting system comprises a single adjustment mechanism for operation of both the tilt mechanism and the slide mechanism to selectively adjust the angular, horizontal and vertical position of the wheelchair back relative to the wheelchair posts.

In one aspect, the mounting system comprises a fixed system that is not readily disengaged.

The mounting system allows for adjustment the wheelchair back relative to the wheelchair posts, preferably using a single adjustment point and preferably with the user seated in the wheelchair.

BRIEF DESCRIPTION OF THE DRAWINGS

Corresponding reference numbers indicate corresponding structures throughout the various figures.

BEST MODE FOR CARRYING OUT THE INVENTION

Figure 1:
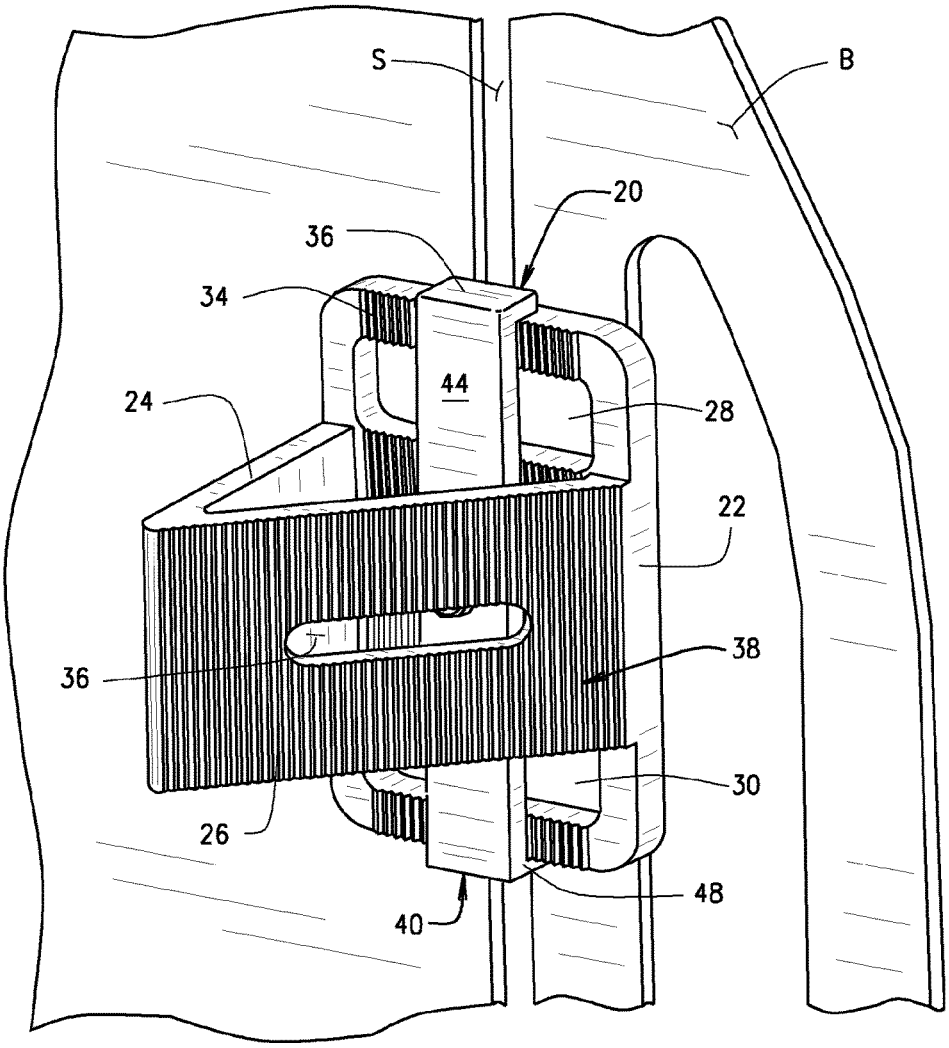
FIG. 1 is an enlarged perspective view of an illustrative embodiment of one aspect of a bracket for wheelchair back mounting assembly secured to a wheelchair back.

A wheelchair back mounting system is described. In general, the system comprises mounting brackets for attachment to a wheelchair back. One each of the mounting brackets is attached to each side of the wheelchair back. The mounting bracket is slidingly engaged in a vertical groove or similar structure in the wheelchair back to allow vertical adjustment of the bracket. The bracket also can be adjusted forward and backward along a horizontal path.

Interchangeable attachment hardware is secured to the mounting bracket for attaching the wheelchair back to wheelchair posts. The system is designed to accommodate multiple types of attachment hardware. In one aspect, the attachment hardware comprises a hanger configured to attach to, or hang from, horizontally orientated mounting posts extending from the wheelchair posts. In one aspect a surface of the hanger abuts a surface of the mounting bracket and is secured to the mounting bracket through a horizontal slot formed in a bracket surface, such that the hanger can move back and forth along a horizontal path relative to the mounting bracket. The respective abutting surfaces also can rotate about each other to allow adjustment of angular position of the wheelchair back. The surface of the mounting bracket and the abutting surface of the hanger have complementary texturing. When the two surfaces are in engagement, the textures interlock to help secure the wheelchair back in its desired position.

In one aspect, the hanger is secured to the mounting bracket, lo and the mounting bracket is secured to the wheelchair back with a single bolt to allow the vertical, horizontal and angular adjustment of the wheelchair back through one bolt.

In another aspect, the attachment hardware comprises a quick-release apparatus that is secured to a bracket which in turn is attached to a vertically orientated slot in the wheelchair back. The quick release apparatus can move back and forth along a horizontal path and can rotate relative to the bracket. The quick release apparatus is designed to insert into the open end of a wheelchair post and is secured by a tight friction fit through an expansion plug mechanism.

More particularly and referring the drawings, a wheelchair back mounting system is shown for attaching wheelchair back B to the vertical wheelchair posts. The described system is used to mount wheelchair back B to wheelchair frame back canes or posts P so as to suspend wheelchair back B on the wheelchair frame above and behind the wheelchair seat (not shown). The construction and arrangement of a wheelchair frame and wheelchair posts are generally illustrated in U.S. Pat. No. 5,364,162, which is incorporated herein by reference.

It will be understood that while the detailed description will focus on one mounting system positioned on one side of a wheelchair back, a second wheelchair back mounting system (which is a mirror image of the mounting system described hereinafter) is attached to the opposite side of wheelchair back B. Although not shown, in use the back B could have some type of cushion, for example a foam cushion or air cell cushion secured to a front surface of the back B.

It will be noted that the components of the wheelchair back mounting assembly described are constructed of a durable, light weight material, such as thermoplastic, aluminum or other acceptable material. These materials are illustrative only and the choice of materials does not affect the scope of the invention. The components and function of the adjustment system will be described in greater detail hereinafter.

Figure 2:
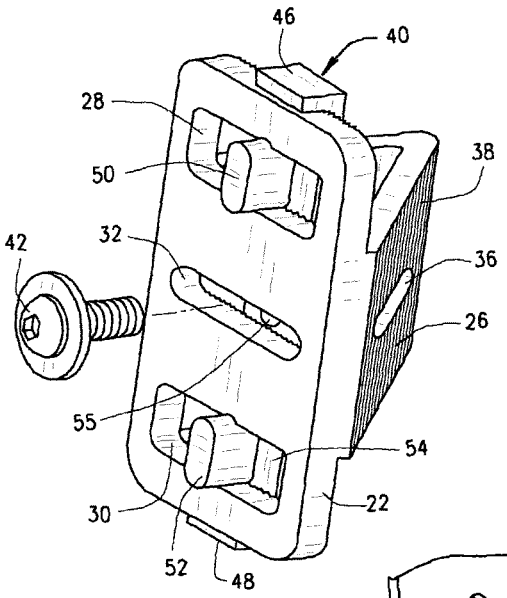
FIG. 2 is an enlarged rear perspective view of bracket components.
Figure 3:
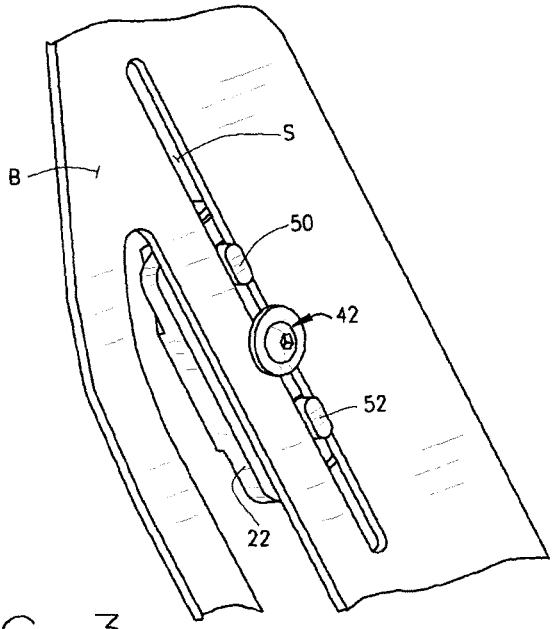
FIG. 3 is a rear perspective view of the bracket slider and bolt engaged in a slot in the wheelchair back.

In one aspect, the wheelchair back mounting system includes a mounting bracket 20 shown in FIGS. 1 through 3. Mounting bracket 20 is secured to back B and, as will be explained, accommodates attachment hardware to attach the back to the wheelchair posts. Mounting bracket 20 is secured to the wheelchair back B at vertical slot S formed in the back. It would be acceptable to incorporate other structure in place of slot S, for example, a track attached to the back or similar structure. The only limitation would be that the structure extend vertically along the back and allow vertical adjustment of mounting bracket 20.

Mounting bracket 20, as illustrated, has a substantially triangular configuration and comprises a mounting wall 22, which abuts the wheelchair back, a side wall 24 and a front wall 26. Front wall 26 also can be referred to as the face of the bracket. Front wall 26 is optimally angled relative to mounting wall 22 such that when the bracket is attached to a wheelchair back and attachment hardware is affixed to the mounting bracket, the attachment hardware on each side of the wheelchair back is in parallel alignment.

In this aspect of a bracket, mounting wall 22 has a vertical length greater than the vertical height of side wall 24 and front wall 26 and these last recited walls are positioned at the center of mounting wall 22. As best seen in FIG. 2, plate 22 includes an upper horizontal slot 28, a lower horizontal slot 30 and a center horizontal slot 32. Mounting wall 22 also comprises a textured front surface 34, which in the illustrated embodiment is a vertically grooved surface. It will be understood that any type of texturing may suffice as long as it functions as will be described, below. Front wall 26 includes a centrally positioned horizontal slot 36. Front wall 26 also has a textured outer surface 38, which in the illustrated embodiment comprises a plurality of vertical grooves.

Bracket 20 is affixed to wheelchair back B at slot S by slider 40 and bolt and washer 42. Slider 40 has a flat body 44 which is the approximate length of mounting wall 22, an upper lip 46 and lower lip 48. An upper guide 50 and a lower guide 52 extend out from the back surface 54 of slider 40. The guides are configured and dimensioned such that they can engage slot S of the wheelchair back and move freely up and down in the slot without excess play. Surface 54 is textured, in this aspect, the texturing comprised of vertical grooves that are complementary to the vertical grooves of front surface 32 of the mounting wall. There is a bolt hole 55 in the center of the slider.

As seen in FIG. 2, when the bracket is assembled, upper lip 46 of slider 40 overlaps the top edge of mounting wall 22 and lower lip 48 overlaps the bottom edge of mounting wall 22. Upper guide 50 extends through upper horizontal slot 28 and lower guide 52 extends through lower horizontal slot 30 of the mounting wall. The two guides engage slot S in the wheelchair back. Bolt and washer 42 is inserted through the back side of slot S, through center horizontal slot 32 and engaged in bolt hole 55 and secured with a nut and washer assembly. Alternatively, the bolt hole could be threaded. It will be understood that the bolt can be loosened and the entire assembly slid up or down in slot S until it is in a desired position. Furthermore, bolt 42 can be loosened and bracket 20 can be moved along a horizontal path front to back. The slider remains positioned at slot S by guides 50, 52 while the bracket moves back and forth with the upper horizontal slot 28 and lower horizontal slot 30 of mounting wall 22 riding the guides. When the desired position is achieved bolt 42 is tightened and textured surface 54 of the slider engages complementary textured front surface 32 of the mounting wall to keep the elements from moving while bolt 42 is tightened to secure the elements in place.

It will be appreciated that when bolt 42 is loosened, lips 46 and 48 on slider 40 keep the slider in place on mounting wall 22 of the bracket and prevent rotation of the slider. Guides 50 and 52 maintain the slider aligned in slot S. These features not only help maintain the elements in proper position, no parts are removed when adjusting the vertical or horizontal position of the bracket. The position of the bracket, and consequently the associated wheelchair back, can be adjusted with a patient seated in the wheelchair by loosening bolt 42 and moving the bracket.

Figure 4:
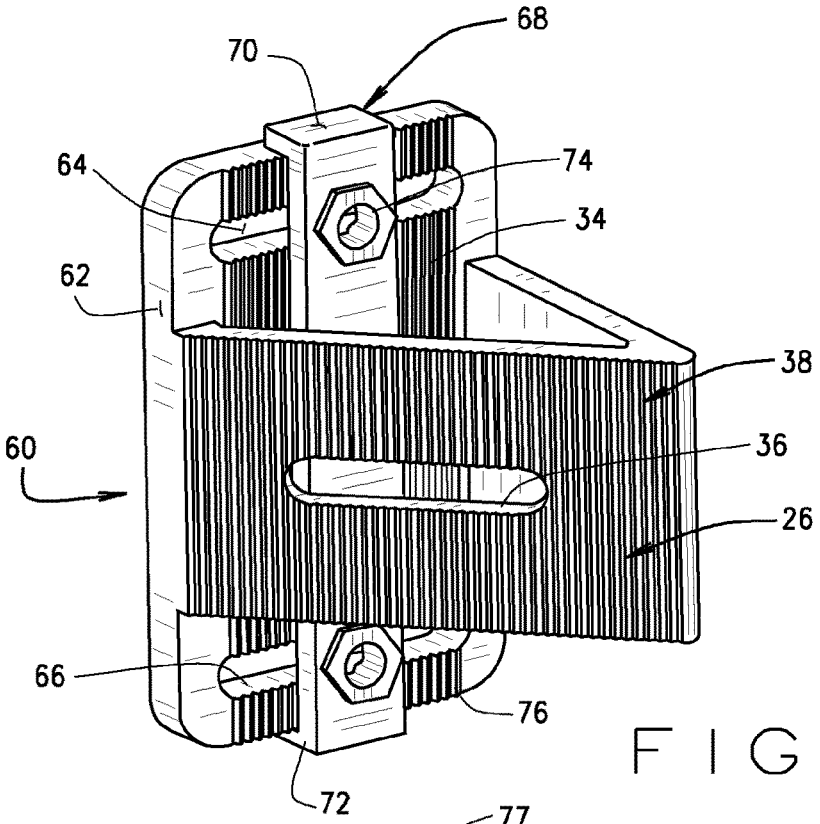
FIG. 4 is a front perspective of another aspect of an assembled bracket.

FIG. 4 illustrates another aspect of a bracket 60. In this aspect bracket 60 is configured much like bracket 20, above.

However, bracket 60 includes a mounting wall 62 having an upper horizontal slot 64 and a lower horizontal slot 66 but no middle slot. The surface 67 of mounting wall is textured. Bracket 60 includes slider 68 having a top lip 70 and a bottom lip 72 which engage the top and bottom edges of the mounting wall. Slider 60 includes a top hole 74 and a bottom hole 76 in alignment with upper horizontal slot 64 and lower horizontal slot 66, respectively. Slider 68 has a textured surface (not seen) complementary to the texture of surface 63. Bracket 60 is attached to back B through slot S by an upper bolt (not shown) and lower bolt (not shown) that extend through slot S, through the upper and lower horizontal slots 64, 66 and the top and bottom holes 74, 76, respectively. The bolts are secured with nut and washer assemblies or the bolt holes can be treaded. The bolt heads can be drawn against the wheelchair back when tightened. The bolts can be loosened to effect vertical and horizontal adjustment of the bracket, as explained above. The bolts also function similarly to guides 50, 52 of slider 40, above.

Figure 5:
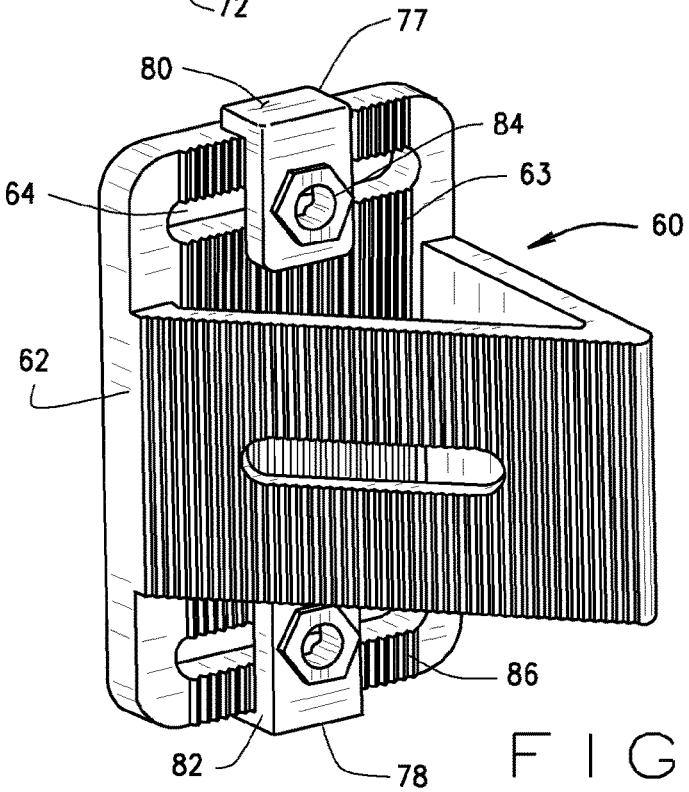
FIG. 5 is a front perspective of another aspect of an assembled bracket.

FIG. 5 illustrates another aspect of bracket 60. As shown, bracket 60 includes a top insert 77 positioned at upper horizontal slot 64 and a bottom insert 78 positioned at lower horizontal slot 66. Top insert 77 includes a lip 80 that overlaps the top edge of mounting wall 62 and bottom insert 78 has a lip 82 that overlaps the bottom edge of mounting wall 62 to keep the inserts properly positioned. Furthermore, the inner surface of each insert (not seen) has texturing complementary to textured surface 63.

The top and bottom inserts have bolt holes 84 and 86, respectively. A bolt (not shown) is inserted through vertical slot S, through upper horizontal slot 64, bolt hole 84 in the top insert. A second bolt (not shown) is inserted through vertical slot S, through lower horizontal slot 66 and bolt hole 86 in the bottom insert. The bolts can be secured with nut and washer assemblies (not shown) or the bolt holes can be threaded. In any event, the bolt heads can be drawn against the wheelchair back when tightened. The bolts can be loosened to effect vertical and horizontal adjustment of the bracket, as explained above. The bolts also function similarly to guides 50, 52 of slider 40, above.

Figure 8:
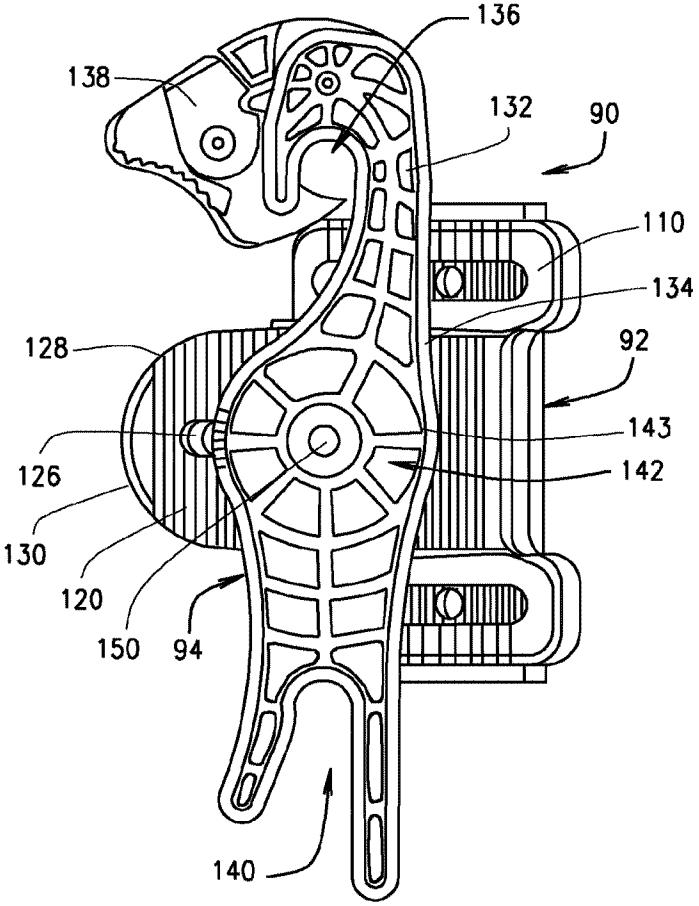
FIG. 8 is a front plan view thereof.
Figure 6:
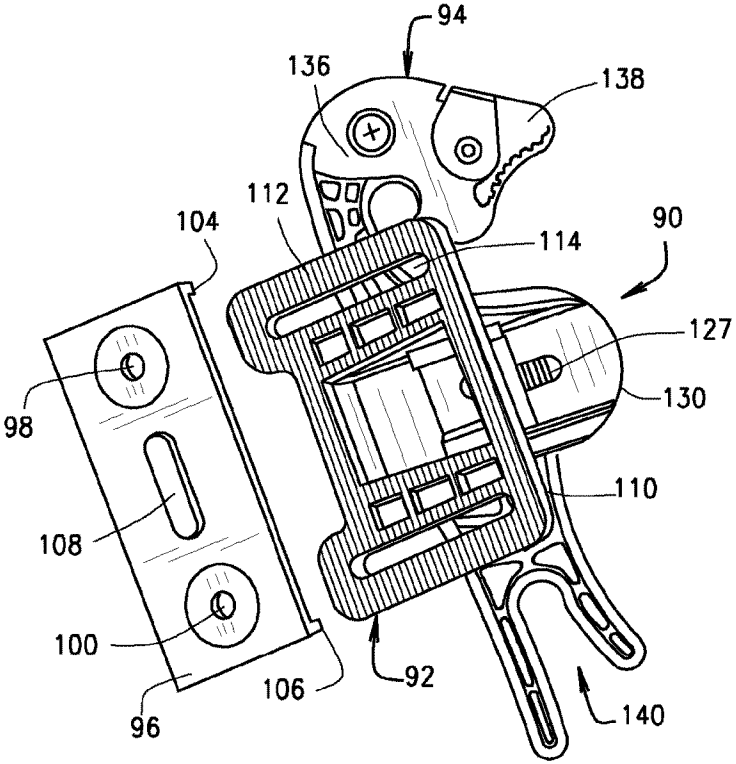
FIG. 6 is a rear perspective view of a wheelchair back mounting system employing one aspect of the mounting hardware.
Figure 7:
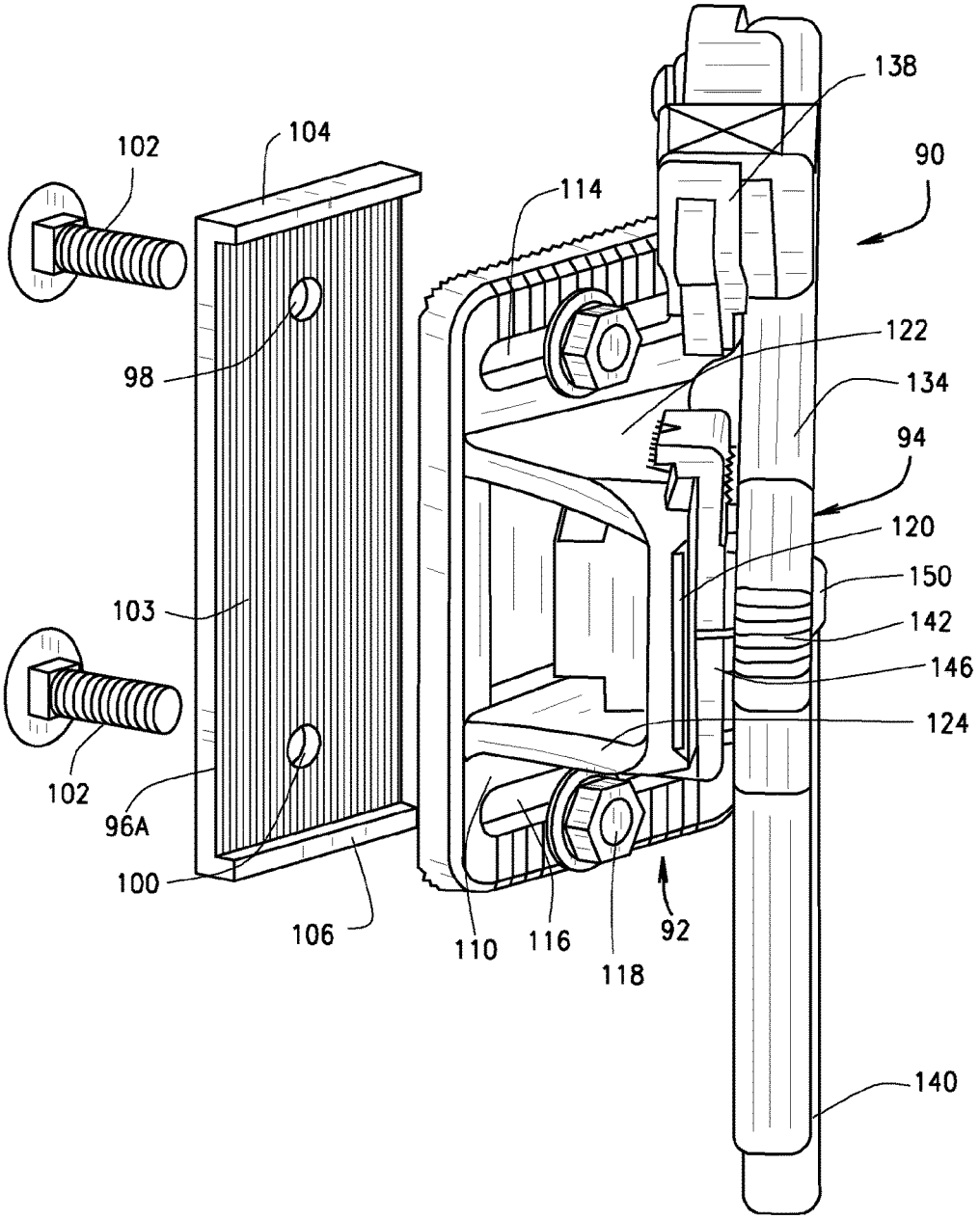
FIG. 7 a partially exploded front view thereof.

FIGS. 6-8 illustrate other aspects of a bracket and attachment hardware assembly indicated general by reference number 90. Assembly 90 includes a bracket 92 and attachment hardware which comprises a hanger assembly 94. As seen in FIGS. 6-8 (as well as FIGS. 11 and 12), bracket 92 includes a mounting plate 96 positioned against the outer surface of a wheelchair back at slot S. Mounting plate 96 includes a top bolt hole 98 and a bottom bolt hole 100. Carriage bolts 102 are inserted through slot S to engage each of the bolt holes. Plate 96 has a textured face 103 which, in the illustrated aspect comprises vertical grooves. Plate 96 has a top lip 104 and a bottom lip 106 and a centrally positioned longitudinal slot 108. Mounting plate 96A, shown in FIG. 7, has no longitudinal slot.

Bracket 92 is substantially triangular includes a mounting wall 110 that abuts mounting plate 96 (or 96A) and is sized and configured to fit between top lip 104 and bottom lip 106. Mounting wall 110 has a textured surface 112 that is complementary to textured surface 103 of the mounting plate. Mounting wall 102 defines a top horizontal slot 114 and a bottom horizontal slot 116 that align with bolt holes 98 and 100, respectively. Horizontal slots 114 and 116 accept bolts 102 and are secured with nut and washer assemblies 118. Bracket 92 has an outwardly angled front wall 120 or face, a top wall 122 and bottom wall 124 that connect the front wall to the mounting wall. The angle of front wall 120 is such that when the bracket and attachment hardware is secured to a wheelchair back having curvature or wings, the attachment hardware on each side of the back is parallel. Front wall 120 includes a substantially centrally positioned horizontal slot 126 and a textured surface 128. As shown front wall 120 has as a rounded or arcuate outer end 130 that eliminates exposed corners and is aesthetically pleasing.

Hanger assembly 94 is designed to suspend back B from horizontally disposed mounting posts extending from the wheelchair posts, as described in co-pending patent application Ser. No. 13/055,834, which is incorporated herein by reference. Hanger assembly 94 includes a hanger 132 that, in the drawings, is shown in a substantially vertical orientation. However, the angle or tilt of hanger 132 can be adjusted as will be explained, below. Hanger 132 has an elongated body 134, a top hook 136 with a securing latch 138, a bottom fork 140 and a rounded middle section 142, with a central bolt hole 143, at the approximate midpoint of body 134. In use, the wheelchair post or cane will include a pair of horizontally extending attachment posts located on the wheelchair post one above the other. Top hook 136 is configured and dimensioned to engage the top post and fork 140 is configured and dimensioned to engage the lower post.

In one aspect, bracket 92 and hanger assembly 94 includes an adjustment washer 146 (best seen in FIG. 12) positioned between the bracket and hanger, abutting front wall 110 of the bracket. Adjustment washer 146 includes top and bottom lips 147 that overlap front wall 120. The surface of adjustment washer 146 that abuts front wall 120 of the bracket is textured such that it engages the texturing of the front wall. The outer surface 148 of adjustment washer 146 is textured. Adjustment washer 146 includes a centrally positioned bolt hole 149. The inner surface of middle section 142 of hanger 122 has complementary texturing to outer surface 148 of the attachment washer. A bolt 150 extends through hole 143 in the middle section 142, through hole 149 in the attachment washer, through horizontal slot 126 in front wall 120 and is secured with a nut and washer combination on the backside of front wall 120. In use bolt 150 can be loosened and the angular orientation of hanger 122 adjusted by rotating middle section 142 about the adjustment washer. The angular orientation of the wheelchair back, relative to the wheelchair posts, the can be adjusted. By tightening bolt 150 the parts are drawn together, the abutting textured surfaces engage, and the seat back is secured at the desired angle. Furthermore, the height of the wheelchair back can be adjusted by moving the bracket up and down in slot S and the front to back or horizontal position of the wheelchair back can be adjusted by bracket mounting wall 110 back and forth in mounting plate 96 (or 96A).

Figure 10:
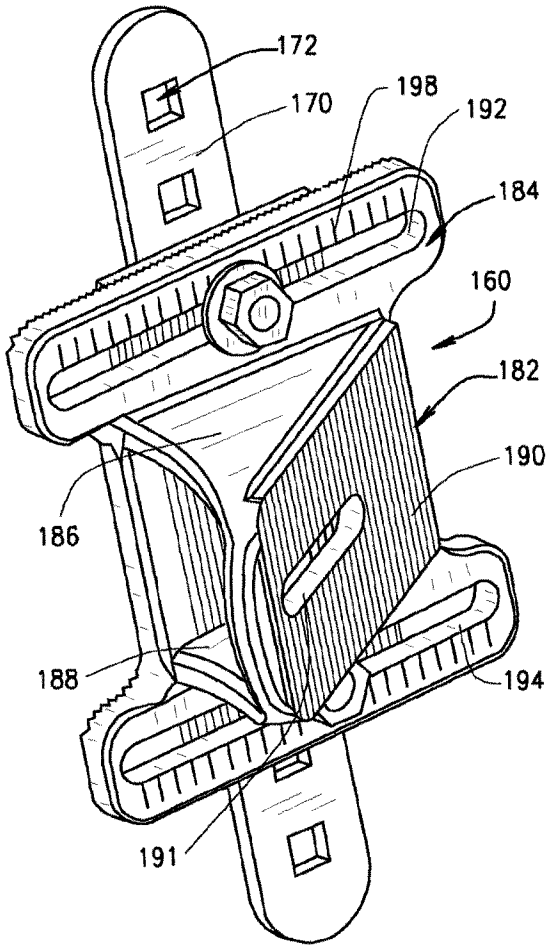
FIG. 10 is a front perspective view of the assembled bracket of FIG. 9.
Figure 9:
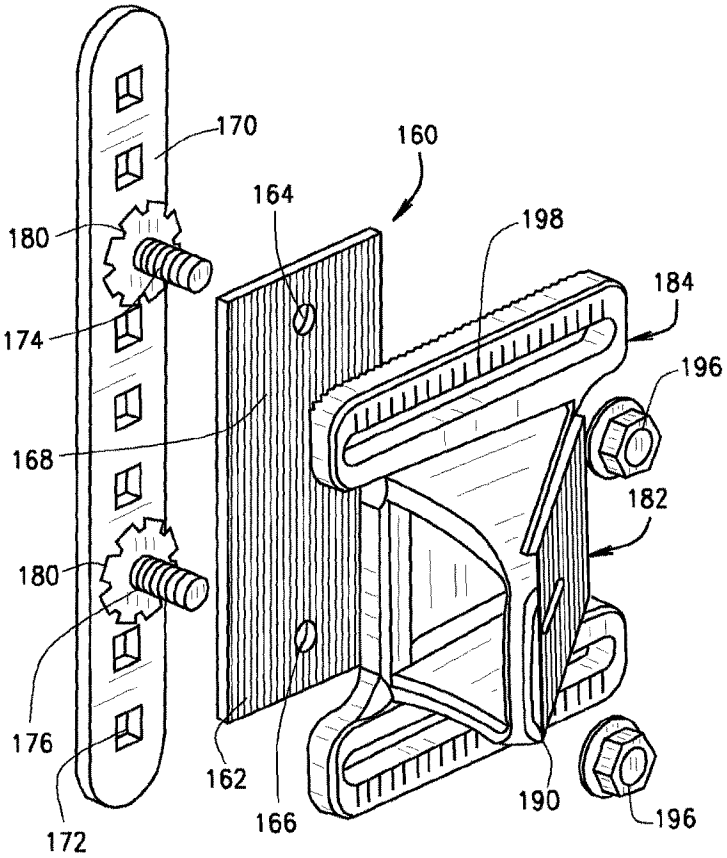
FIG. 9 is an exploded view of another aspect of a bracket.

In another aspect of a bracket is best seen in FIGS. 9 and 10, and indicated generally by number 160. Bracket 160 includes a flat mounting plate 162. Mounting plate 162 includes a top bolt hole 164 and bottom bolt hole 166. The outer surface 168 of mounting plate 162 is textured. In this aspect, bracket 160 includes an elongated, flat backing plate 170 which is positioned inside the wheelchair back against slot S. Backing plate 170 has a plurality of openings 172 along its length. Backing plate 170 includes a top stove bolt 174 and bottom bolt 176 each inserted through one of the openings 150. It will be appreciated that openings 172 have a rectangular configuration to seat a rectangular neck portion of a stove bolt and prevent turning or rotation of the bolt in the hole during manipulation. Each bolt is retained in its opening 172 by a retainer washer 180 Bolts 174 and 176 are positioned to extend through slot S and engage holes bolt holes 164 and 166, respectively, in mounting plate 162.

Bracket 160 includes triangle bracket 182 that includes a bracket frame 184, a top wall 186, bottom wall 188 and front wall 190. Front wall 190 has a central slot 191. The back surface of bracket frame 184 is textured in a manner complementary to outer surface 168 of mounting plate 162. Again, front wall 190 is angularly orientated as previously explained. Bracket frame 184 has a top horizontal slot 192 and a bottom horizontal slot 194. Bolts 174 and 176 extend through horizontal slots 192 and 194, respectively, and the assembly is secured together with by tightening nuts 196 on the bolts. The outer face of bracket frame 184 can have indicia, as at 198, that can be used to mark optimal positioning of the bracket along a horizontal path. The horizontal position of bracket 160 is by loosening nuts 196 and sliding bracket frame 160 forward or backward over bolts. It will be appreciated that bracket 160 may be used with hanger assembly 94 previously described or with other mounting hardware, such as the mounting hardware assembly which will now be described.

Figure 12:
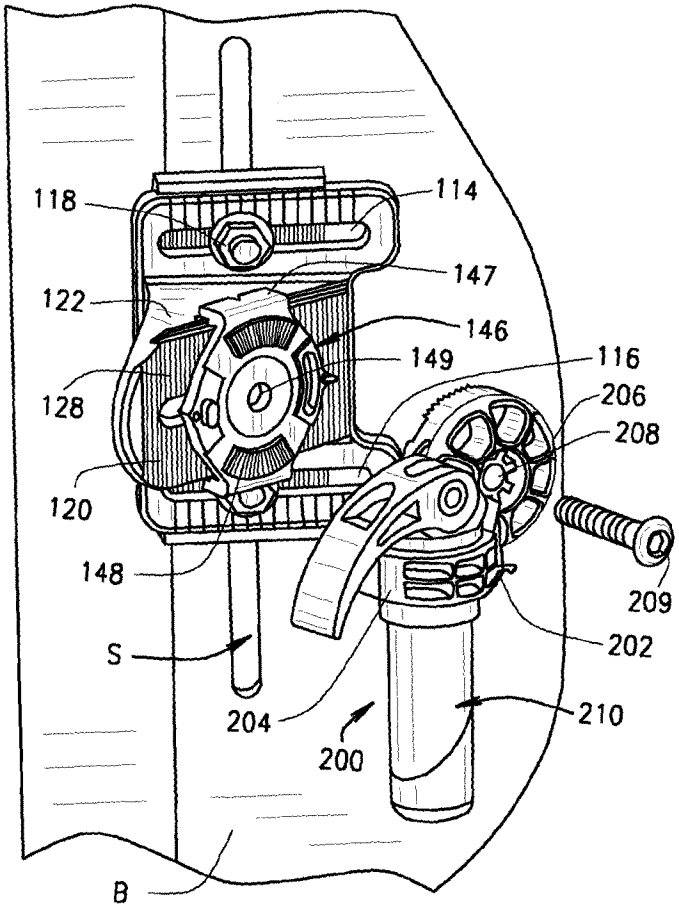
FIG. 12 is a partially exploded view of the wheelchair back mounting system of FIG. 11.
Figure 11:
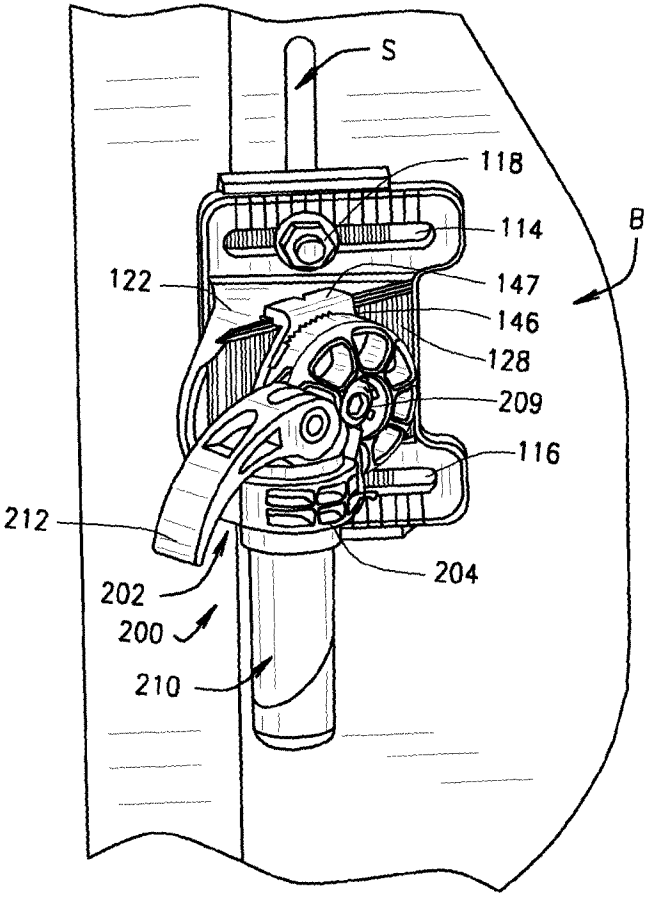
FIG. 11 is a front perspective view of one aspect of a wheelchair back mounting system attached to a wheelchair back.
Figure 13:
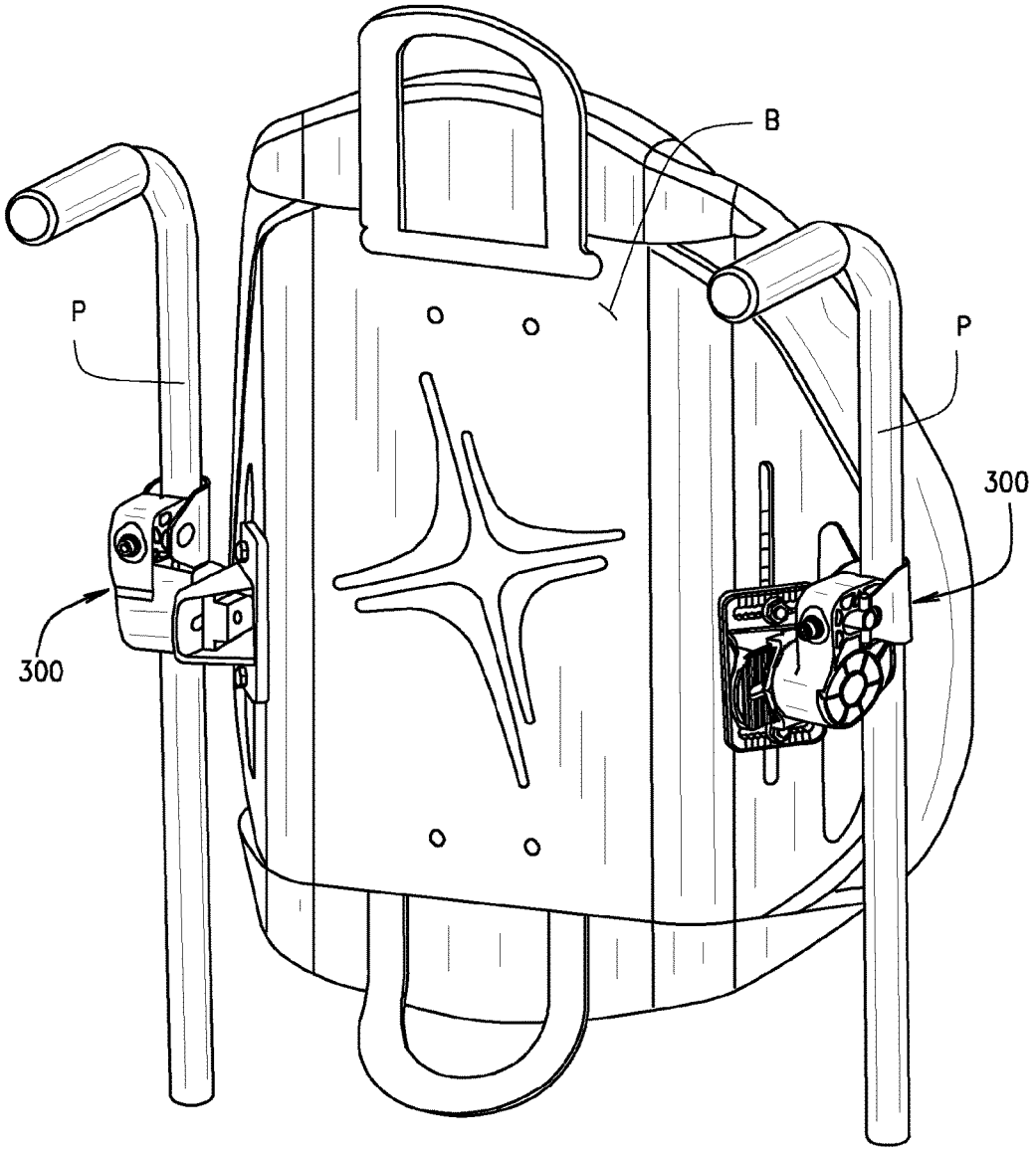
FIG. 13 is rear perspective view of a wheelchair back and fixed mounting system.
Figure 14:
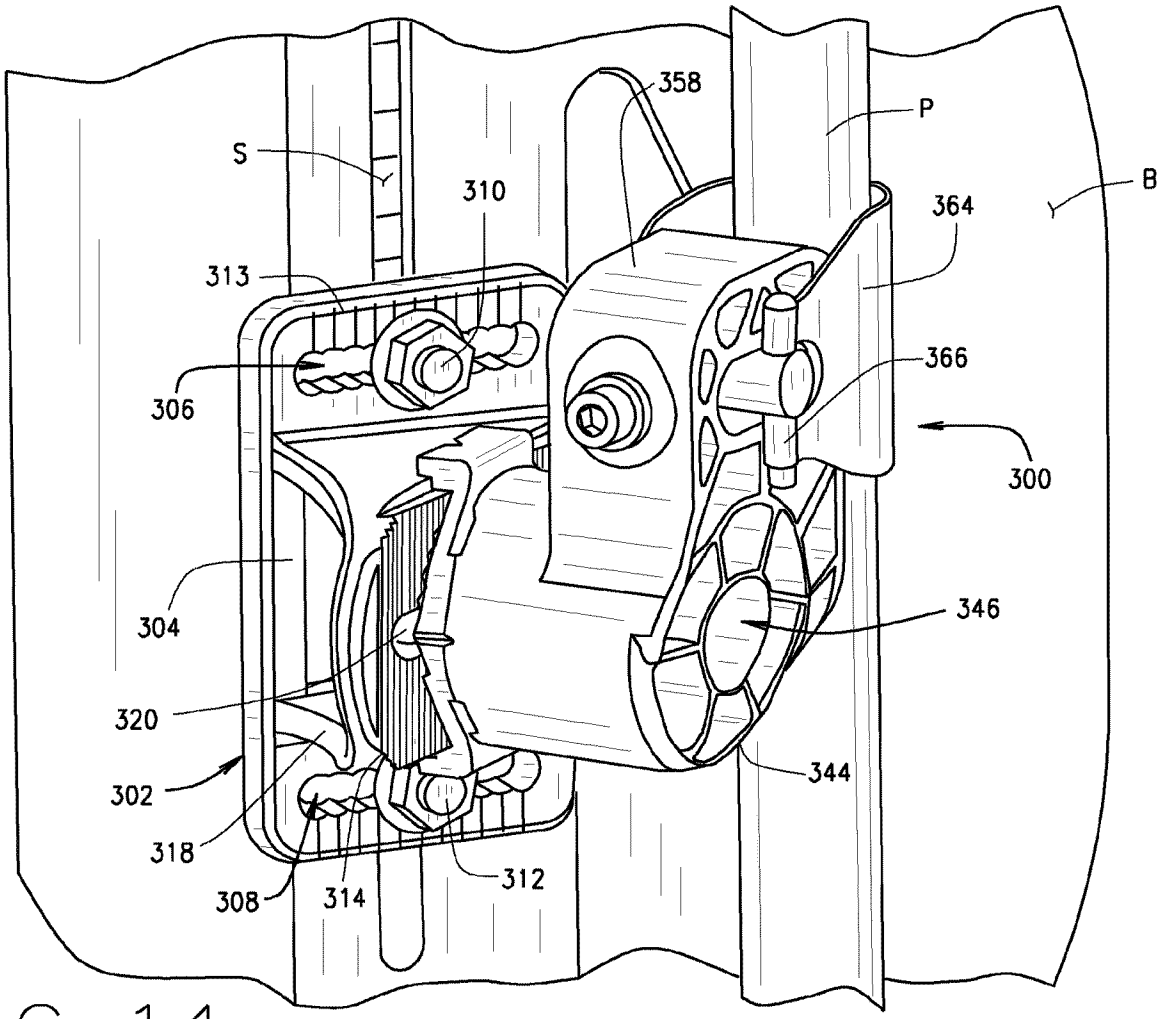
FIG. 14 is an enlarged rear perspective view of fixed mounting hardware.
Figure 15:
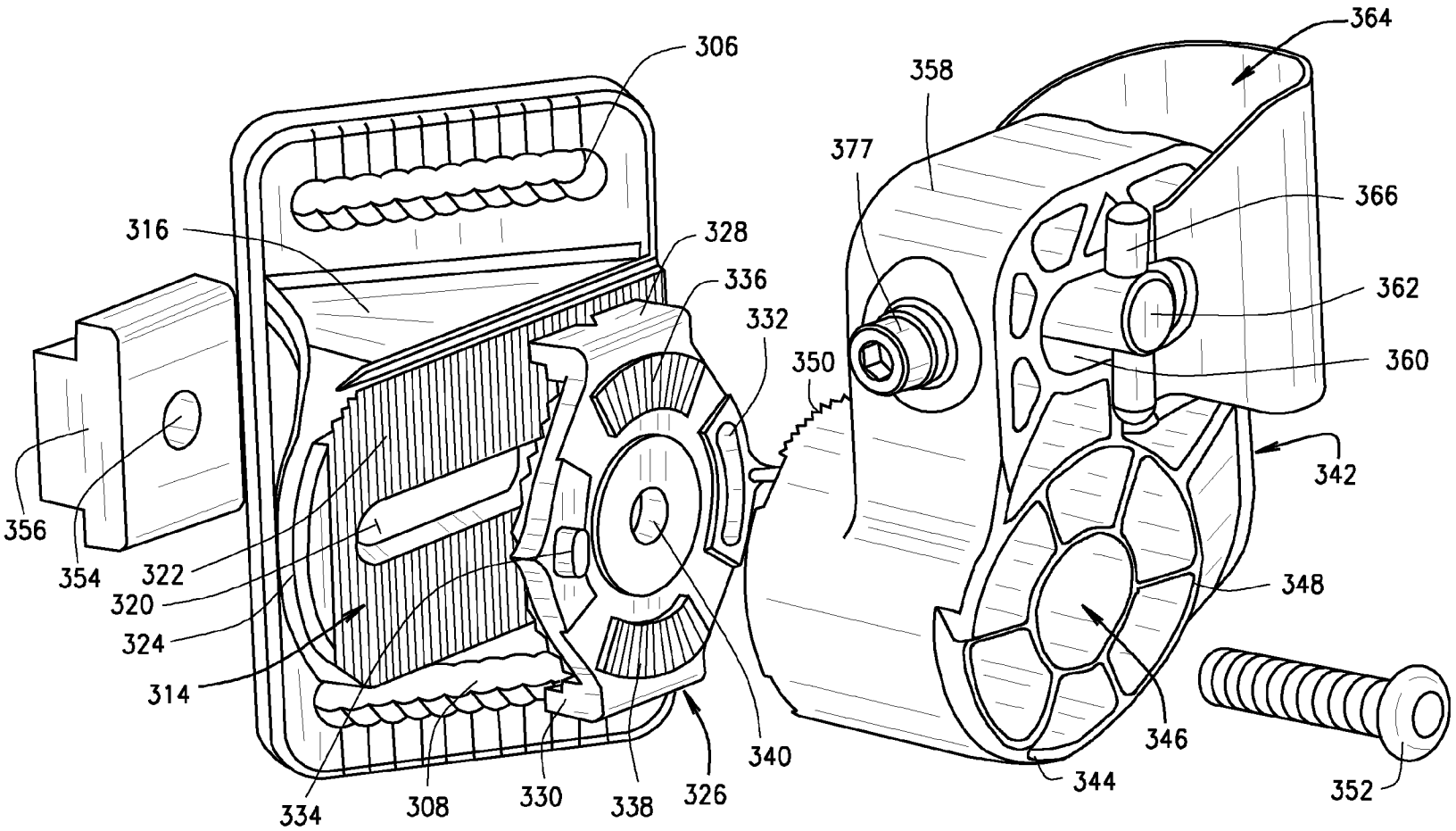
FIG. 15 is an exploded view thereof.
Figure 16:
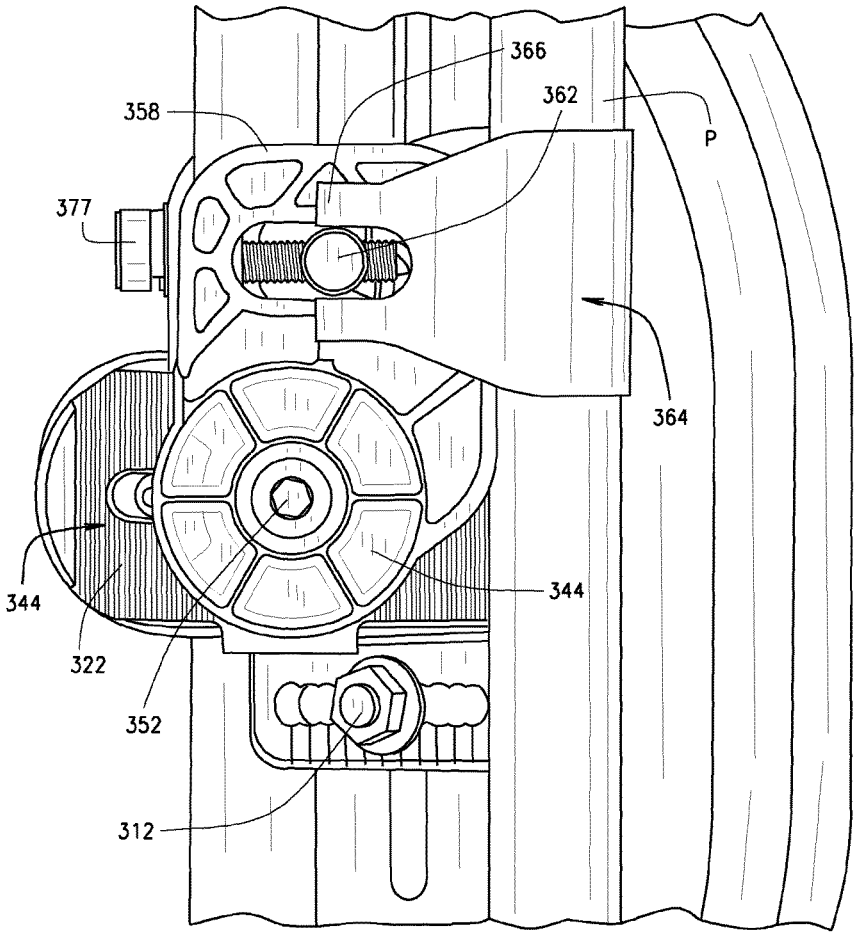
FIG. 16 is a side elevational view thereof.
Figure 17:
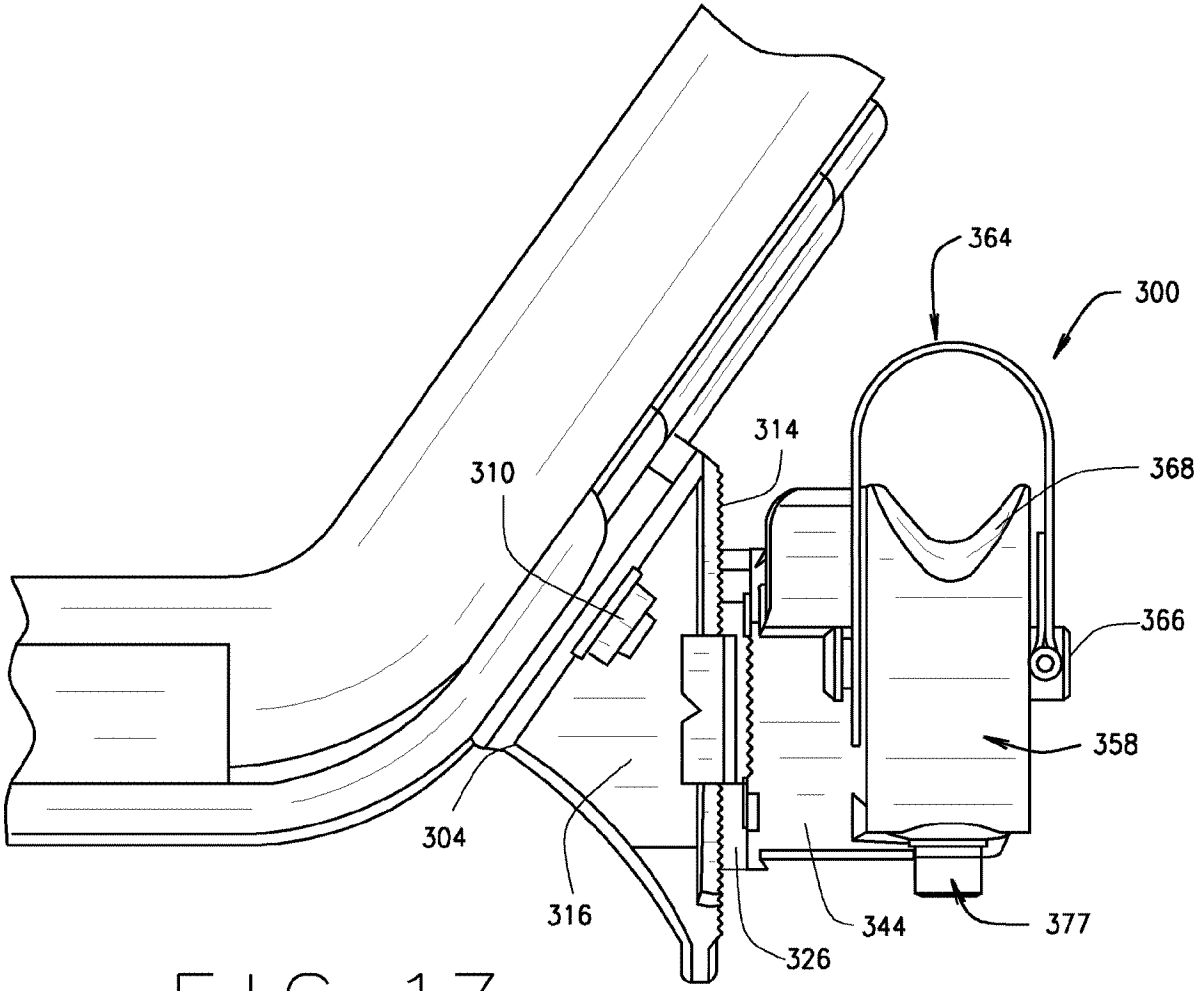
FIG. 17 is a top plan view thereof.

FIGS. 11 and 12 illustrate a bracket and attachment hardware assembly referred to generally by number 200. Assembly 200 includes bracket 92 and attachment hardware assembly 202. Bracket 92 is constructed and configured as described above. Bracket 92 includes adjustment washer 146 having lips 147 that overlap and engage front wall 120. Adjustment washer 146 has a textured inner surface (not seen) that engages the texture surface 128 of front wall 120, and a textured outer surface 148. There is a bolt hole 149 through the center of adjustment washer that is in communication with horizontal slot 126 in front wall 120.

Attachment hardware assembly 202 is constructed and configured to attach in the open end tubular of a wheelchair post. Attachment hardware assembly 202 includes a horizontally orientated collar 204 having a central bore (not seen) and a vertically orientated attachment disk 206. The inner surface (not seen) of attachment disk 206 is textured and complementary to the texturing on the outer surface 148 of adjustment washer 146 Attachment disk 206 has a central bolt hole 208. A bolt 209 extends through central bolt hole 208 of the attachment disk, through hole 149 in the adjustment washer and through slot 126 in front wall 120 of the bracket There is a lever actuated expansion plug 210 rotatably engaged in the bore of collar 204. Expansion plug 210 can be inserted into the open tubular end of a wheelchair post. The lever 212 is engaged and the plug is secured in the wheelchair post by a tight friction fit. Bolt 209 can be loosened to effect angular adjustment of the wheelchair back relative to the wheelchair posts by rotating adjustment washer 146 about the inner face of attachment disk 206. Nuts 118 can be loosened and the assembly can be moved back and forth along a horizontal path, as well, to effect adjustment of the wheelchair back.

A fixed system is illustrated in FIGS. 13 through 17.The term "fixed" is intended to connote a mounting system that is not as readily released to allow quick removal of the wheelchair back as those discussed above. The fixed system does allow for removal of the wheelchair back, however, as will be explained. As shown, the fixed system comprises a first and second fixed mounting hardware assembly indicated generally by reference number 300. There is one hardware assembly 300 one each side of back B removably attached to wheelchair posts P. As seen, the two hardware mounting assemblies are mirror images of each other. For purposes of simplicity and clarity, one assembly 300 will be described in detail. Assembly 300 includes a triangle bracket 302, which is similar in construction to bracket 92 shown in FIG. 7.

Bracket 302 is substantially triangular includes a mounting wall 304 that abuts wheelchair back B at slot S. Mounting wall 304 defines a top horizontal slot 306 and a bottom horizontal slot 308 that accepts bolts 310 and 312, respectively, that extend through slot S and are secured with nut and washer assemblies. There are hash marks 313 or other indicia adjacent the horizontal slots that serve as markers for the positioning of the bracket, which can be slid back and forth on the bolts until properly positioned on back B.

Bracket 302 includes an outwardly angled front wall 314 or face, a top wall 316 and bottom wall 318 that connect the front wall to the mounting wall. The angle of front wall 314 is such that when the bracket and attachment hardware is secured to a wheelchair back having curvature or wings, the attachment hardware on each side of the back is parallel. Front wall 314 includes a substantially centrally positioned horizontal slot 320 and a textured surface 322. As shown front wall 314 has as a rounded or arcuate outer end 324 that eliminates exposed corners and is aesthetically pleasing.

Hardware assembly 300 may include a mounting disk 326. Disk 326 includes a top ear 328 and bottom ear 330 that can fit over the top and bottom edges of front wall 314. The back surface of disk 326 is textured such that it can engage complementary textured surface 322 of front wall 314. The front face of disk 326 includes an arcuate groove 332 on one said and a stop 334 on the opposite side, a top textured section 336 and a bottom textured section 338. There is a central bolt hole 340 in the disk.

Hardware assembly 300 includes a clamp assembly 342 comprising a body 344 having a central longitudinal bore 346. Body 344, as shown, is substantially cylindrical having a first or outer end 348 and a second or inner end 350.

Although the inner end is not shown, it will be understood that it includes an arcuate groove that accepts stop 334 and a stop that engages arcuate groove 332, as well as texturing complementary to the top and bottom textured sections 336, 336.

Body 344 and disk 326 can be rotated about the longitudinal axis relative to each other to change the angular adjustment of back B. However, the stop and arcuate groove arrangements delimit the extent to which the clamp assembly can be rotated. Bolt 352 extends through bore 346, hole 340, slot 320 and engages threaded hole 354 in anchor block 356. It will be appreciated that bolt 353 can be loosen to effect angular adjustment as well as back and forth adjustment of the wheelchair back, comprising a single adjustment point.

Body 344 includes a band block 358 on the top surface. Band block 358 includes an elongated slot 360. A laterally extending rod 362 is slidingly engaged in slot 360. One arm of a band 364 is pivotally connected to one end of rod 362 at pivot hinge 366; the opposite arm is releasably secured to the other end of rod 362. When the band is released, it can swing open about pivot hinge 366 for attachment around wheelchair post P. There is a screw actuated clamp block 368 at one side of band block 358 An elongated screw 370 extends through a bore (not seen) in band block 358 and engages clamp block 368. Rotation of screw 370 urges clamp block 368 forward to impinge wheelchair post P between the clamp block and the band to secure the assembly on the post. The sliding engagement of rod 362 in slot 360 allows the band to be drawn forward until sufficiently tight impingement is achieved Although disk 326 and body 344 are described as separate parts, it will be noted that the two parts could be integral. That is, the inner end of body 344 can be configured similar to disk 326.

The various parts of the assembly may be constructed from metal or a durable resin material that is milled or molded to make the parts.

Although several representative aspects of attachment hardware are described and illustrated, they are representative of broader aspects of the system. Any attachment hardware that works effectively with a bracket to adjustably secure a wheelchair back to wheelchair posts is encompassed by the disclosure.

It will be understood that elements of the bracket assemblies and attachment hardware are configured or referred to as having specific shapes or configurations such disks, collars, rounded, elongated, grooved and so forth. These configurations are intended to provide certain aesthetic benefits and are not necessarily dictated by function. Any shape or configuration of an element that functions for its intended purposes is intended to be encompassed by the disclosure. Such terms should not be construed as limiting in any manner.

The invention claimed is:

1. An attachment assembly for attaching a wheelchair back to at least one wheelchair post, the wheelchair back defining a first vertical slot on a first side and a second vertical slot on a second side, the attachment assembly comprising:

a bracket engaged in one of the vertical slots in the wheelchair back, said bracket comprising a mounting wall and a front wall, the front wall defining a horizontal slot;

a slider bar attached to the mounting wall of the bracket, the slider bar having a back surface and comprising:

at least one guide extending from the back surface of the slider bar, wherein the at least one guide is slidably engaged in one of the vertical slots in the wheelchair back; and at least one bolt engaged with the mounting wall and passing through one of the vertical slots in the wheelchair back; and attachment hardware attached to the bracket at the horizontal slot and adapted to be mounted to a post of a wheelchair, where in at least one of said bracket or attachment hardware is adjustable, wherein the attachment hardware further comprises an expansion plug assembly configured for insertion into an open end of the at least one wheelchair post.

2. The attachment assembly of claim 1 wherein the attachment hardware comprises a hanger apparatus for engaging a mounting clamp assembly on the wheelchair post.

3. The attachment assembly of claim 2 wherein the hanger apparatus comprises at least one hook structure for engaging a laterally extending hanger post on a wheelchair post.

4. The attachment assembly of claim 3 wherein the hanger apparatus comprises a bottom fork for engaging a second laterally extending hanger post on a wheelchair post.

5. The attachment assembly of claim 1 wherein the position of the bracket is adjusted by moving the bracket up or down in the slot.

6. The attachment assembly of claim 1 wherein the attachment hardware is slidingly engaged in the horizontal slot in the front wall of the bracket and the position of the attachment hardware is adjusted by moving the attachment hardware back and forth in the horizontal slot.

7. The attachment assembly of claim 1 wherein said bracket front wall comprises a plurality of grooves.

8. The attachment assembly of claim 7 wherein a surface of the attachment hardware comprises a plurality of complementary grooves.

9. The attachment assembly of claim 1 wherein the attachment hardware comprises a clamp assembly.

10. The attachment assembly of claim 9 wherein the clamp assembly further comprises a clamp having a body comprising a band block and a band extending from a first side of the band block to a second side of the block, said band disposed to encircle a wheelchair post.

11. The attachment assembly of claim 10 wherein a first arm of the band is pivotally connected to the band block about a pivot hinge that is substantially parallel to the at least one wheelchair post.

12. The attachment assembly of claim 10 further comprising a screw actuated clamp block at one side of the band block wherein rotation of the screw urges the clamp block forward to impinge a wheelchair post between the clamp block and the band to secure the assembly on the post.

13. The attachment assembly of claim 10 wherein the body further comprises a surface for engaging the front wall of the bracket.

14. The attachment assembly of claim 13 wherein the bracket can be rotated about the surface of the body to adjust angular orientation of a wheelchair back.

15. An attachment assembly for attaching a wheelchair back to at least one wheelchair post, the wheelchair back defining a first vertical slot on a first side and a second vertical slot on a second side, the attachment assembly comprising:

a bracket engaged in one of the vertical slots in the wheelchair back, said bracket comprising a mounting wall and a front wall, the front wall defining a horizontal slot;

a slider bar attached to the mounting wall of the bracket, the slider bar having a back surface and comprising:

at least one guide extending from the back surface of the slider bar, wherein the at least one guide is slidably engaged in one of the vertical slots in the wheelchair back; and at least one bolt engaged with the mounting wall and passing through one of the vertical slots in the wheelchair back;

attachment hardware attached to the bracket at the horizontal slot and adapted to be mounted to a post of a wheelchair, where in at least one of said bracket or attachment hardware is adjustable; and a clamp assembly including a clamp having a body further comprising a band block and a band extending from a first side of the band block to a second side of the band block, said band disposed to encircle a wheelchair post and wherein a first arm of the band is pivotally connected to the band block about a pivot hinge that is substantially parallel to the at least one wheelchair post.

16. The attachment assembly of claim 15 further comprising a screw actuated clamp block at one side of the band block wherein rotation of the screw urges the clamp block forward to impinge a wheelchair post between the clamp block and the band to secure the assembly on the post.

17. The attachment assembly of claim 15 wherein the body further comprises a surface for engaging the front wall of the bracket.

18. The attachment assembly of claim 17 wherein the bracket can be rotated about the surface of the body to adjust angular orientation of a wheelchair back.

* * * * *